United States Patent [19]

Harreld et al.

[11] Patent Number: 4,829,602

[45] Date of Patent: May 16, 1989

[54] PROTECTIVE GOWN

[75] Inventors: Donald R. Harreld, Woodstock; Lawrence G. Ponsi, Wheeling; John J. Newton, Jr., Palatine, all of Ill.

[73] Assignee: Sage Products, Inc.,, Cary, Ill.

[21] Appl. No.: 173,110

[22] Filed: Mar. 28, 1988

[51] Int. Cl.[4] ..... A41D 13/00; A41D 13/04; A41D 27/10

[52] U.S. Cl. ..... 2/51; 2/DIG. 7; 2/243 B; 2/113

[58] Field of Search ..... 2/113, 114, 115, 243 B, 2/DIG. 7, 59, 60, 243 R, 51

[56] References Cited

U.S. PATENT DOCUMENTS

| | | | |
|---|---|---|---|
| 2,430,745 | 11/1947 | Pierre | 2/59 |
| 2,554,380 | 5/1951 | Olrich et al. | 2/113 X |
| 2,686,913 | 8/1954 | Brierley | 2/114 X |
| 2,918,677 | 12/1959 | Pindyck | 2/113 X |
| 3,464,063 | 9/1969 | Hoegerman | 2/DIG. 7 |
| 3,719,955 | 3/1973 | Hrubecky | 2/243 R |
| 4,493,116 | 1/1985 | Niethammer et al. | 2/155 X |
| 4,523,336 | 6/1985 | Truman | 2/115 X |
| 4,532,655 | 8/1985 | Bowditch | 2/243 B |
| 4,561,126 | 12/1985 | Truman | 2/DIG. 7 X |
| 4,631,756 | 12/1986 | Scrivens | 2/114 X R |

FOREIGN PATENT DOCUMENTS

| | | | |
|---|---|---|---|
| 287546 | 5/1928 | United Kingdom | 2/59 |

*Primary Examiner*—Werner H. Schroeder
*Assistant Examiner*—Jeanette E. Chapman
*Attorney, Agent, or Firm*—Lee & Smith

[57] ABSTRACT

A disposable protective gown and process for making the gown. The gown is composed of a body portion which extends over the shoulders of the wearer and which has a pair of sleeves which extend outwardly from opposite sides. Each sleeve is attached to the body portion over an angle of attachment greater than 180° and less than 300°. A thumb loop is formed at the end of each of the sleeves and is shaped to engage the saddle of the thumb of a wearer. In forming the gown, after the body portion has been cut and the sleeves formed, the sleeves are attached to the body portion by heat sealing half the sleeve, then rotating the sleeve so that a second portion of the sleeve is attached to the gown, with the total angle of attachment not exceeding 300°. In order to prevent inadvertent sealing of both sides of a sleeve together, each sleeve includes a circumferential notch which extends for a length up to that comprising the portion of a the sleeve that is not attached to the body of the gown.

20 Claims, 2 Drawing Sheets

PROTECTIVE GOWN

BACKGROUND OF THE INVENTION

This invention relates to gowns for use in hospitals and clinics, and more particularly to a disposable protective gown intended for single use applications.

Gowns of the nature of that of the invention are used to protect the wearer, normally from contamination or infection. Various types of gowns have been developed in the past for these purposes. U.S. Pat. No. 4,612,673 discloses a gown which fastens in the front of a patient. U.S. Pat. Nos. 4,504,978 and 4,586,196 disclose a full body gown which fastens behind the wearer. U.S. Pat. No. 4,608,719 discloses a disposable, pullover-type gown with integral arms. U.S. Pat. No. 4,523,335 discloses a rear-fastening gown with tie straps to maintain the gown in place.

One problem with gowns of the prior art is the tendency of the sleeves of the gown to "ride up" the arms of the user. Many gowns employ elastic cuffs to aid in maintaining proper sleeve orientation, but the problem of maintaining sleeves in a proper orientation has not been solved by the use of elastic. When contamination is of paramount concern, and when the gown is employed in a procedure where the wearer also wears gloves, the wearer cannot afford the possibility of an unprotected gap occuring between the glove and the sleeve during use of the gown because the sleeve has crept up the wearer's arm. While the sleeve could be attached to the glove, such is cumbersome, time consuming and often rather uncomfortable.

SUMMARY OF THE INVENTION

The present invention relates to a disposable protective gown which is easy to use, is retained properly in place when worn, and which has sleeves which do not tend to ride up the arm of the wearer. The gown has a body portion having an upper part formed to extend over the shoulders of the wearer. The upper part has a central head aperture so that the gown may be worn in a pullover fashion. A pair of tubular sleeves extend outwardly from opposite sides of the upper part of the gown, with each sleeve being secured to the gown over an angle of attachment greater than 180° and less than 300°. A thumb loop is formed at the end of each sleeve and is shaped to engage the saddle of the thumb of the wearer.

In accordance with the preferred embodiment of the invention, in order to properly gather the gown about the wearer's wrist, the gown also includes an elastic cuff. To hold the gown in place on the wearer, integral tie staps extend from opposite sides of the body portion of the gown.

The central head aperture in the gown is sufficiently large to ensure that the gown can easily be pulled over the head of any wearer. The gown also includes a score extending outwardly from the head aperture which facilitates easy removal of the gown and, in instances where the gown must be worn tightly gathered about the neck of the wearer, the gown can be separated at the score with the separated portions then being tied or adhesively secured to one another about the neck to eliminate any gap between the wearer's neck and the gown.

The thumb loop prevents the sleeves from riding up the arms of the wearer. The thumb loops are oriented so that when the wearer dons the gown, the thumb openings extend forwardly and downwardly from the gown, in a natural orientation so that the arm need not be rotated to an unnatural position when the gown is donned, and also to insure that the arms of the gown are not twisted on the wearer during use.

The arm of the gown are attached in what is commonly known as a "set-in" sleeve arrangement. To insure that the gown does not droop forwardly across the shoulders of the wearer, the angle of attachment of the sleeves to the gown is, as set forth above up to a maximum of 300°. In the preferred embodiment of the invention, that angle of attachment is approximately 270°, or three-fourths of the circumferential dimension of the sleeve. To facilitate attachment of the sleeve to the body portion of the gown without the sleeve being sealed to itself, the sleeve is notched for a circumferential length up to that equaling the portion of the sleeve that is not attached to the body portion of the gown.

In forming of the gown, after the body portion and sleeves have been made, the sleeves are attached to opposite sides of the upper part of the body portion of the gown by first securing a first portion of one end of each sleeve to the upper part over an angle of attachment of approximately 180°. The sleeve and gown is then rotated so that a second portion of each end of each sleeve is attached to the upper part of the body portion over an angle of attachment greater than 0° and less than 120°, so that the aggregate angle of attachment of each sleeve to the gown is greater than 180° but less than 300°. The seals are contiguous or overlap to insure that a liquid barrier is properly formed throughout the heat seal region.

BRIEF DESCRIPTION OF THE DRAWINGS

The invention is described in greater detail in the following description of an example embodying the best mode of the invention, taken in conjunction with the drawings figures, in which.

DESCRIPTION OF AN EXAMPLE EMBODYING THE BEST MODE OF THE INVENTION

Figure 1:
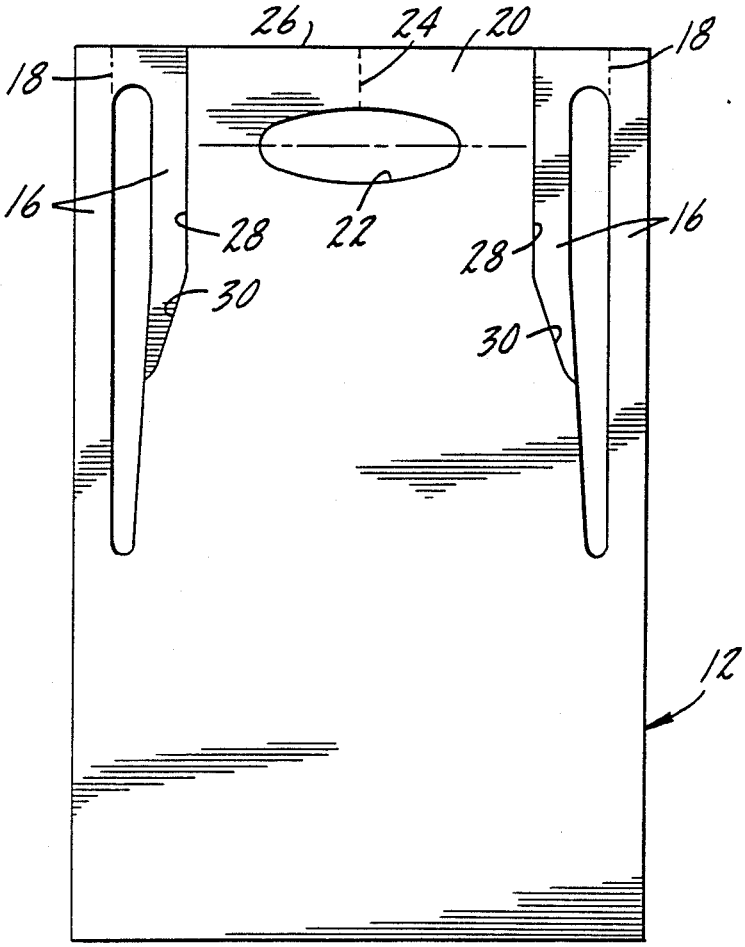
FIG. 1 is a plan view of the body portion of the gown, after it has been cut but before attachment of the sleeves.

A disposable protective gown according to the invention is shown generally at 10 in the drawing figures. The gown is composed of two basic elements, a body portion 12 and a pair of sleeves 14. As indicated above, the fully assembled gown is illustrated in FIGS. 4 and 5, with portions thereof and steps of the assembly shown in FIGS. 1 through 3.

Figure 2:
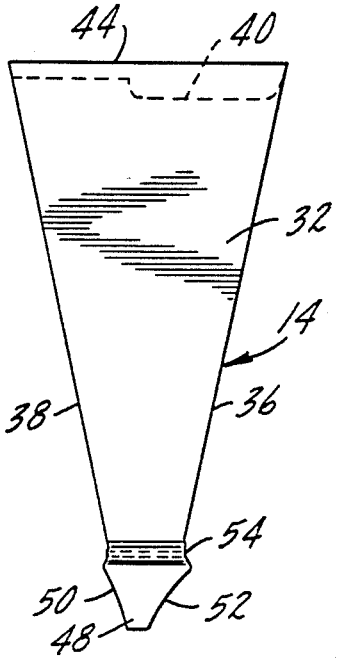
FIG. 2 is a plan view of one assembled sleeve before attachment to the body portion of the gown.
Figure 4:
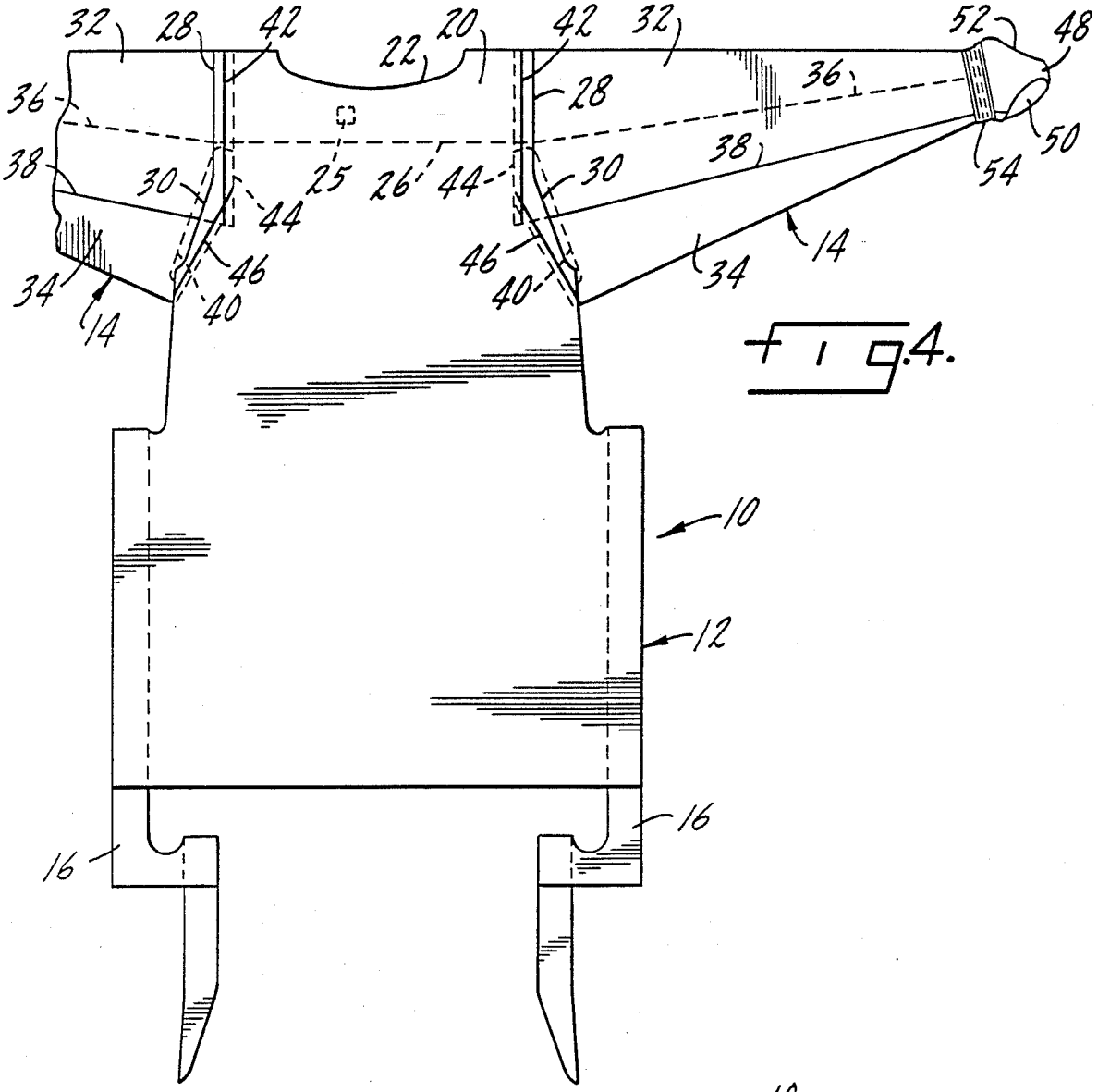
FIG. 4 is a front plan view of the gown illustrated in FIG. 3 with the sleeves fully attached.
Figure 5:
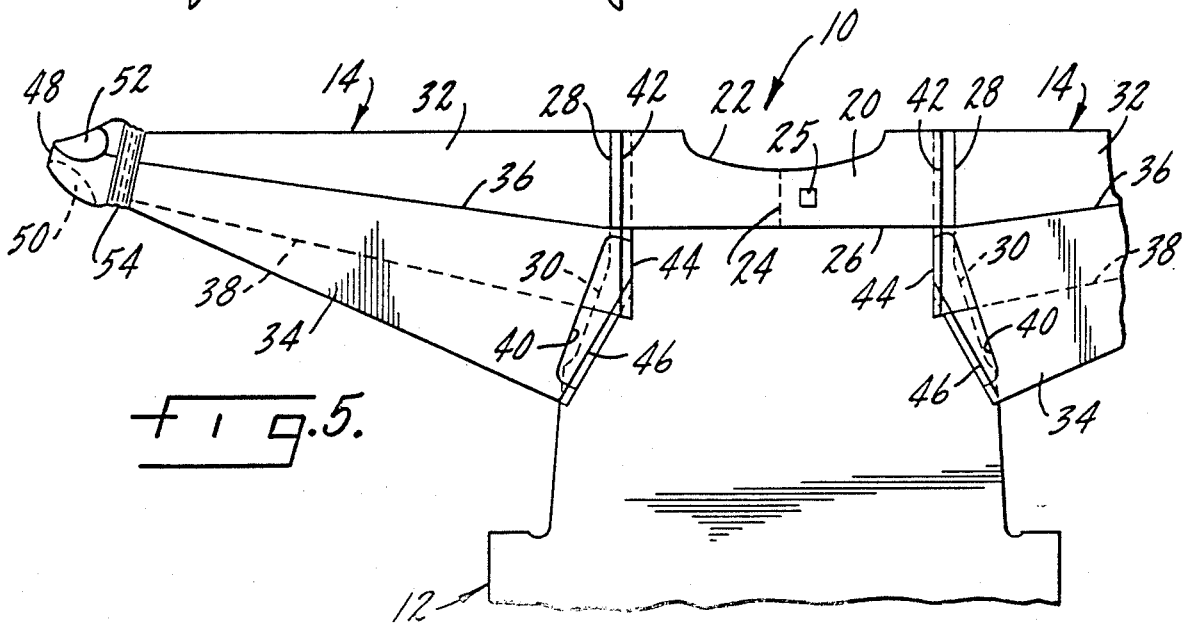
FIG. 5 is a rear plan view, with portions omitted, of the gown shown in FIG. 4.

Turning first to the body portion 12, as best shown in FIG. 1, the body portion 12 is formed from a rectangular sheet of material, such as thin, flexible plastic, and has a pair of integral tie straps 16 cut therefrom and extending from opposite sides, as shown in FIGS. 1 and 4. The tie straps 16 can be quite long so that they can be wrapped about the body of the wearer and tied in front, or as shown in FIG. 2, each of the tie straps 16 can be shortened to be tied only in the rear, being cut at a line 18 shown in phantom. The remainder would be discarded.

The body portion includes an upper part 20 which is formed to extend over the shoulders of the wearer of the gown. An oval central head aperture 20 is cut out of the upper part 20. Also formed in the upper part 20 is a score 24 which extends outwardly from the head aperture 22 to an edge 26 of the body portion 12, the edge 26 forming the lower extent of the rear of the gown 10 when worn, as best shown in FIG. 5. An adhesive tab 25, with a removable release liner (not illustrated), is located as shown. The score 24 is a weakened tear line, and the gown may be severed at the score 24 to facilitate removal of the gown from the wearer or, if desired for any reason, when the gown 10 is worn, the score 24 can be severed, the release liner removed, and the severed halves of the upper part 20 secured to one another at the adhesive tab 25 so that the gown is tightly gathered about the wearer's neck. If the severed halves of the upper part 20 are long enough, alternatively the gown may be tightly tied around the neck of the wearer by tying the opposite halves of the upper part 20.

When the tie straps 16 are severed from the body portion 12, remaining is a first attachment segment 28 which extends parallel to the longitudinal axis of the body portion 12. Also remaining is a second attachment segment 30 which extends outwardly at an oblique angle to the longitudinal axis of the body portion 12. As explained in a moment in connection with the description of FIGS. 3 through 5, the attachment segments 28 and 30 are those locations of the upper part 20 of the body portion 12 to which the sleeves 14 are attached.

The sleeve 14 is formed in the shape of a conical tubular member which may be composed of two separate segments of plastic 32 and 34 which are sealed at their edges by heat seals 36 and 38. The segments 32 and 34 are substantially trapezoidal in shape, with the segment 34 being truncated slightly and further including a circumferential notch 40 which extends substantially for a length equal approximately to that portion of the sleeve 32 that is not attached to the upper part 20, as explained in greater detail below.

The sleeves 14 are attached to the upper part 20 of the body portion 12 over an angle of attachment of greater than 180° and less than 330°. Preferrably, the angle of attachment is approximately 270°, or three-fourths of the circumference of the tubular sleeve 14, as shown in the drawing figures. The term angle of attachment is intended to mean that portion of the circumferential dimension of the sleeve 14 that is attached to the upper part 20 of the body portion 12.

Figure 3:
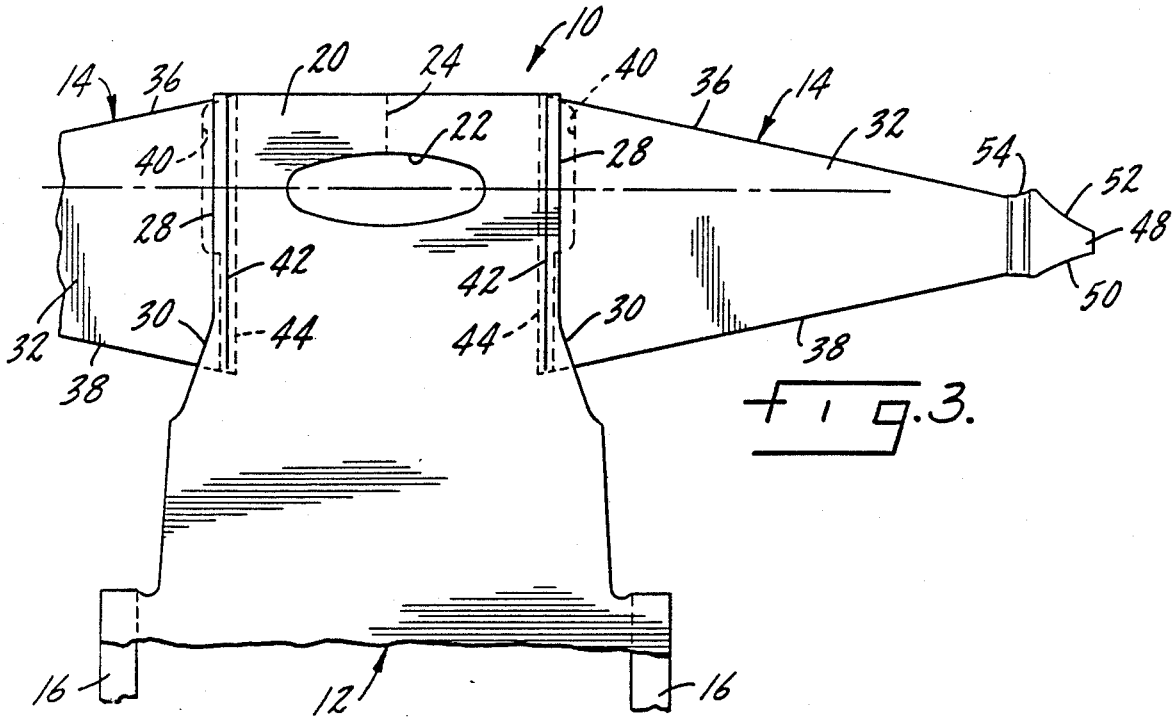
FIG. 3 is a partial plan view of the gown according to the invention, illustrating the first step in the process of attaching the sleeves to the body portion of the gown.

It is important that the sleeve 14 be attached to the body portion 12 over an angle of attachment greater than 180° to ensure that the gown 10, when worn, does not droop forwardly from the shoulders of the wearer. To obtain a greater than 180° attachment, and in order to avoid use of an internal mandrel or other complicated means of attachment of the sleeves 14 to the body portion 12, the sleeves 14 are preferably attached to the body portion in a two step process. The first step is shown in FIG. 3. In that step, each of the sleeves 14 (the right sleeve being the mirror image of the left sleeve, and vice versa), is heat sealed at 42 to the upper part 20 adjacent the first attachment segment 28. As shown in FIG. 3, the end portion 44 of the segment 32 of the sleeve 14 is inserted beneath the attachment segment 28 and is sealed thereto by the first heat seal 42. Because the end portion 44 extends beyond the corresponding end portion of the segment 34 of the sleeve 42, the heat seal 42 does not seal the sleeve 14 closed when being sealed to the upper part 20, but rather seals only the segment 32 of the sleeve 14 to the upper part 20.

After the first heat seal 42 is completed for each of the sleeves 14, the top portion of the upper part 20 is turned beneath the remainder of the upper part 20, as shown in FIG. 4, and a second heat seal 46 is applied to secure a second portion of the sleeve 14 to the upper part 20 adjacent to the second attachment segment 30. The seals 42 and 46 are contiguous or overlap to insure that the area of sealing of the sleeves 14 to the body portion 12 creates a barrier to penetration of any liquids. Because the notch 40 is formed in the piece 34 of the sleeve 14, the sleeve is not sealed to itself, but rather is left unattached to any part of the body portion 12 along the length of the notch 40. Since the notch 40 occupies approximately one half of the width of the segment 34, the aggregate angle of attachment of the sleeve 14 to the body portion 12 as shown in the drawing figures is all but the notch 40, or approximately 270°.

Each sleeve 14 also includes a thumb loop 48 which is shaped to engage the saddle of the thumb of the wearer of the gown 10. The thumb loop 48 has a thumb opening 50 on one side thereof and a fingers opening 52 on the opposite side. When the gown 10 is formed, and as best shown in FIGS. 4 and 5, the thumb opening 50 is located to extend forwardly and downwardly from the gown, in a natural orientation for the wearer so that when the wearer dons the gown 10, as the wearer's arm is inserted within the sleeve 14, the thumb naturally seeks the thumb opening 50, while the fingers naturally seek the fingers opening 52. This orientation also assures that the sleeves 14 of the gown 10, when worn are not twisted about the arms of the wearer.

As indicated above, the thumb loops 48 of the sleeves 14 serve to prevent the sleeves 14 from "riding up" the arms of the wearer. To aid holding the sleeves 14 in place, and also seal the sleeves about the wrist of the wearer, each of the sleeves 14 may also include an elastic cuff 54 which gathers the sleeve 14 about the wrist of the wearer when the gown 10 is worn.

The thumb loop 48 is preferably heat sealed to the end of each sleeve 14. During the heat sealing process, or separately, an elastic band can be inserted to form the elastic cuff 54. Other conventional means of forming an elastic cuff can be employed, as desired.

The gown 10 is formed in a relatively straight forward manner. The body portion 12 is formed from a sheet of thin, heat sealable plastic or the like, cut along the lines of the attachment segments 28 and 30 and with the portion between the segments of the tie straps 16 being removed. At the same time, the head aperture 22 and score 24 are formed.

Separately, the sleeves 14 are formed as shown in FIG. 2, with the pieces 32 and 34 being heat sealed to one another along the edge heat seals 36 and 38, and with the thumb loop 48 and elastic cuff 54 formed at the smaller end of the sleeve 14.

Thereafter, each of the sleeves 14 is secured to the upper part 20 of the body portion 12. A first portion of the wider end of each of the sleeves 14, comprising the width of the segment 32 is heat sealed to the upper part 20 along the first attachment segment 28. This results in an angle of attachment of approximately 180°, since approximately one half of the sleeve is attached at this time. Thereafter, the sleeve and upper part 20 are rotated, and a second portion of each sleeve 14 is heat sealed at 46 to the upper part 20 of the body portion 12 along the second attachment segment 30, with the angle of attachment of this second portion of each of the sleeves 14 being greater than 0° and less than 120°, such that the aggregate angle of attachment of each of the sleeves 14 to the upper part 20 is greater than 180° and less than 300°. As explained above, the angle of attachment shown in FIGS. 4 and 5 is approximately 270°, or three-fourths of the circumferential dimension of each of the sleeves 14. Because each of the pieces 34 is truncated slightly shorter than the corresponding pieces 32 of the sleeves 14 and due to the use of the notch 40, each of the sleeves 14 is sealed only to the upper part 20 of the body portion 12 without inadvertent sealing of portions of the sleeve to one another.

By means of its material and process of formation, the gown 10 is quite waterproof and contamination resistant. Because the heat seals 42 and 46 adjoin or overlap, the seal of the sleeves 14 to the body portion 12 is waterproof. Also, the elastic cuffs 54 are preferably heat sealed to the sleeves 14 as well, rather than being sown as conventional, eliminating needle holes and gaps as possible locations for entry of fluids and contaminants. The adhesive tab 25 allows the gown to be tightly gathered about the wearer's neck, again reducing the chances of fluid and contaminant entry.

Various changes can be made to the invention without departing from the spirit thereof or scope of the following claims.

We claim:

1. A disposable protective gown comprising a. a body portion having an upper part formed to extend over the shoulders of the wearer of the gown, said upper part having a central head aperture, b. a pair of sleeves extending outwardly from opposite sides of said upper part, each sleeve comprising a tubular member secured at one end to said upper part over an angle of attachment of the one end of said sleeve to said upper part of greater than 180° and less than 300°, and c. a thumb loop formed in each said sleeve at the opposite end thereof and shaped to engage the saddle of the thumb of a wearer.

2. A disposable protective gown according to claim 1 in which the opposite end of said sleeve includes an elastic cuff.

3. A disposable protective gown according to claim 1 including integral tie straps extending from opposite sides of said body portion.

4. A disposable protective gown according to claim 1 including a score in said upper part extending outwardly from said head aperture.

5. A disposable protective gown according to claim 1 in which said thumb loop is located such a thumb opening extends forwardly and downwardly from the gown.

6. A disposable protective gown according to claim 1 in which said angle of attachment is approximately 270°.

7. A disposable protective gown according to claim 1 in which each sleeve includes, at said one end, a circumferential notch extending for a distance up to that portion of the sleeve not attached to said upper part.

8. A process of forming a disposable protective gown, comprising the steps of:

a. forming a body portion having an upper part shaped to extend over the shoulders of the wearer of the gown, b. forming a central head aperture in said upper part, c. forming a pair of tubular sleeves, and d. attaching said sleeves to opposite sides of said upper part, including the steps of i. securing a first portion of one end of each sleeve to said upper part over an angle of attachment of approximately 180°, and ii. securing a second portion of said one end of each sleeve to said upper part over an angle of attachment of greater than 0° and less than 120°, such that the aggregate angle of attachment of each sleeve to said upper part is greater than 180° and less than 300°.

9. A process according to claim 8 in which step "b" includes forming a score in said upper part extending outwardly from the head aperture.

10. A process according to claim 8 including the step of forming a thumb loop in each sleeve at an end thereof opposite to the one end.

11. a process according to claim 8 in which said body portion and said sleeves are formed of a heat sealable material, and the securing of method step "d" comprises heat sealing of said sleeves to said upper part.

12. A process according to claim 8 including the step of forming a circumferential notch in said one of each sleeve prior to step "d", said notch extending for a distance up to that portion of the sleeve not attached to the upper part.

13. A process according to claim 8 including the step of forming integral tie straps at opposite sides of said body portion.

14. A process according to claim 8 including the step of forming an elastic cuff in each sleeve.

15. A process according to claim 8 in which method step "a" includes forming said upper part with opposite sides each having a first attachment segment extending parallel to a longitudinal axis of said body portion and a second attachment segment extending outwardly at an oblique angle to said axis.

16. A process according to claim 15 in which method step "d" includes securing said first portion to said first segment and securing said second portion to said second segment.

17. A disposable protective gown comprising a. a body portion having an upper part formed to extend over the shoulders of the wearer of the gown, said upper part having a central head aperture, and opposite sides of said upper part having a first attachment segment extending substantially parallel to a longitudinal axis of said body portion and a second attachment segment extending outwardly at an oblique angle to said axis, and b. a pair of tubular sleeves extending outwardly from the opposite sides of said upper part, each sleeve having a first portion attached to said first segment and a second portion attached to said second attachment, said portions comprising in the aggregate an angle of attachment greater than 180° and less than 300°.

18. A disposable protective gown according to claim 17 including a thumb loop formed in each sleeve and shaped to engage the saddle of the thumb of a wearer.

19. A disposable protective gown according to claim 18 in which said thumb loop is located such a thumb opening extends forwardly and downwardly from the gown.

20. A disposable protective gown according to claim 17 in which the opposite ends of said sleeve includes an elastic cuff.

* * * * *